United States Patent [19]

Seddon et al.

[11] Patent Number: 4,563,214

[45] Date of Patent: Jan. 7, 1986

[54] END CLOSURE MEMBERS FOR DISCHARGE LAMPS

[75] Inventors: Richard J. Seddon, Leicester; Keith E. Parker, Melton Mowbray; Peter Hing, Leicester, all of England

[73] Assignee: Thorn EMI plc, London, England

[21] Appl. No.: 552,976

[22] Filed: Nov. 17, 1983

[30] Foreign Application Priority Data

Nov. 18, 1982 [GB] United Kingdom ..... 8232968

[51] Int. Cl.[4] ..... C22C 32/00

[52] U.S. Cl. ..... 75/234; 75/235; 419/23; 419/32; 419/35; 419/42; 313/636

[58] Field of Search ..... 75/234, 235; 419/23, 419/32, 35, 42; 313/636

[56] References Cited

U.S. PATENT DOCUMENTS 4,183,746 1/1980 Pearce et al. ..... 75/234

FOREIGN PATENT DOCUMENTS 0028885 10/1980 European Pat. Off. .
1382934 2/1975 United Kingdom .
1571084 7/1980 United Kingdom .

OTHER PUBLICATIONS

"Detection and Measurement of the Effect of Hydrogen in High Pressure Sodium Discharge Lamps" by R. J. Campbell & W. Kroontje (pp. 394–396).

*Primary Examiner*—Stephen J. Lechart, Jr.
*Attorney, Agent, or Firm*—Fleit, Jacobson, Cohn & Price

[57] ABSTRACT

An electrically conducting cermet for use in a closure assembly in a high pressure sodium discharge lamp which cermet comprises a sintered compact of refractory oxide granules and a conducting network extending throughout the cermet wherein said network is provided by a layer of niobium and, optionally, at least one other specified metal. The cermet is, because of the niobium content of the metallic network, permeable to hydrogen and lamps incorporating this cermet can therefore be stabilized in acceptable times.

5 Claims, 4 Drawing Figures x400

END CLOSURE MEMBERS FOR DISCHARGE LAMPS

This invention relates to high pressure sodium discharge lamps with cermet ends. A cermet may be defined as a ceramic material containing a proportion of metal as a separate phase. One example of a cermet is an alumina ceramic containing say molybdenum, tungsten, or iron. Other metals which may be used include titanium, zirconium, tantalum or niobium. Cermets may be electrical conductors or insulators depending on the relative proportions of the oxide and the metals or metal and upon the particle size and distribution of the metal in the sintered material. The inclusion of a ductile metal phase results in an increase in mechanical strength, toughness and thermal shock over the conventional ceramic material. It has been known for some time that cermets may be used in discharge lamp production. For example, in United Kingdom Pat. No. 1382934, a high pressure metal halide discharge lamp is disclosed wherein a discharge lamp arc tube is closed by non-conducting alumina cermet end members and tubular metal current lead-in members are sealed through the non-conducting cermet members. The advantage of this arrangement is said to be that the co-efficient of thermal expansion of the cermet can be made to match the co-efficient of thermal expansion of the metal lead-in member.

In our United Kingdom Pat. No. 1 571 084 and in our European patent publication No. 0028885 electrically conducting cermets are disclosed and claimed which are particularly useful and which obviate the sealing problems associated with the use of a separate current lead-in member. In conventional high pressure sodium discharge lamps it is usual to have tubular niobium current lead-in members sealed through a ceramic, for example, an alumina end closure member to close the ends of the arc tube. Because niobium is permeable to hydrogen the tubular niobium current lead-in member is a very efficient transporter of hydrogen, hence, any hydrogen remaining in the arc tube as an impurity after processing is very quickly diffused out through the niobium tube to where it can be absorbed by some suitable gettering material. The phenomenon of the transport of hydrogen through niobium is well known being described for example in the article "Detection and Measurement of the Effect of Hydrogen in High Pressure Discharge Lamps" I.E.E. conference publication No. 143, pages 393 to 396, 4th International Conference on Gas Discharges, 7–10 Sept., 1976, by R. J. Campbell and W. Kroontje. This paper describes how the presence of hydrogen increases the operating voltage, increases the time taken for voltage stabilisation and generally lowers the efficacy of the lamp. Consequently it will be appreciated that any reduction in the efficiency of hydrogen transportation can have detrimental effects on lamp operation. Nevertheless because niobium is a strategic metal in short supply any conservation or reduction in its use or cost savings related thereto is to be welcomed. It would be much more efficient, for example, to use niobium in its powder form rather than in tube or wire form.

We have found, for example, that some cost savings can be obtained by using niobium rod or wire rather than niobium tube. We have also found by testing that because of the greater path length involved with a niobium rod the hydrogen transportation time, that is the time to remove the hydrogen from the arc tube so that the lamp runs stable is around 15 minutes. The stabilisation time for what might be called a standard 400 watt HP sodium discharge lamp is between 2 to 3 minutes. While a longer stabilisation time of 15 minutes or more, e.g. up to 30 minutes itself leads to an increase in production costs, if this was compensated by savings in material costs, then such a longer stabilisation time would be commercially acceptable.

An object of this invention is to provide a high pressure discharge lamp having a discharge arc tube of light transmitting ceramic material, the arc tube having an end closure assembly including a cermet member arranged to be permeable to hydrogen.

According to the present invention there is provided an electrically conducting cermet comprising a sintered compact of refractory oxide granules having diameters of from 50 to 800 microns, and a conductive network extending throughout the cermet wherein said network is provided by a layer of metal, said layer comprising niobium and, optionally, at least one other metal selected from titanium, zirconium, hafnium, vanadium, tantalum, molybdenum and tungsten, said layer constituting a volume fraction of 0.06 to 0.2 of the total cermet and the minimum niobium component of said layer constituting a volume fraction of 0.06 of the total cermet, and wherein said granules comprise 0.01 to 0.25 percent by weight of the refractory oxide of finely divided, magnesium oxide and either:

(a) a refractory oxide such as aluminium oxide, yttrium oxide or a spinel, or (b) a refractory oxide such as aluminium oxide, yttrium oxide or a spinel and at least one metal selected from titanium, zirconium, hafnium, vanadium, tantalum, chromium, molybdenum, tungsten, iron, cobalt and nickel in a volume fraction of from 0.01 to 0.15 of the total volume of the granules.

According to a further aspect of the invention there is provided a high pressure sodium discharge lamp, the lamp having a discharge arc tube of light transmitting ceramic material such as aluminium oxide, yttrium oxide or a spinel, or a synthetic sapphire, the arc tube including spaced electrodes for sustaining a discharge therebetween, at least one end of the discharge arc tube including a closure assembly, said assembly comprising an electrically conducting cermet comprising a sintered compact of refractory oxide granules, having diameters of from 50 to 800 microns, the cermet comprising a conductive network extending throughout the cermet wherein said network is provided by a layer of metal, said layer comprising niobium and, optionally, at least one other metal selected from titanium, zirconium, hafnium, vanadium, tantalum, molybdenum and tungsten, said layer constituting a volume fraction of 0.06 to 0.2 of the total cermet and the minimum niobium component of said layer constituting a volume fraction of 0.06 of the total cermet, and wherein said granules comprise 0.01 to 0.25 percent by weight of the refractory oxide of finely divided magnesium oxide and either:

(a) a refractory oxide such as aluminium oxide, yttrium oxide or spinel, or (b) a refractory oxide such as aluminium oxide, yttrium oxide or a spinel and at least one metal selected from titanium, zirconium, hafnium, vanadium, tantalum, chromium, molybdenum, tungsten, iron, cobalt and nickel in a volume fraction of from 0.01 to 0.15 of the total volume of the granules.

We have found that the cermets according to the present invention when adapted to act as end closure members in high pressure sodium lamps offer cost savings over end closures employing niobium tube or wire.

In the cermets of the present invention the metallic layer imparting the electrical conductivity is in the form of a network extending throughout the cermet. In the light of our experience with niobium rod it was thought that the consequent long path length particularly when the network did not constitute 100% niobium would provide a barrier to hydrogen transport but, most surprisingly, we have found that a metallic network including a substantial amount of niobium is capable of transporting gaseous species, particularly hydrogen, with an efficiency approaching that of niobium rod. This surprising discovery coupled with the cost savings attributable to the use of niobium in powder form results in a form of cermet extremely useful in high pressure discharge lamp manufacture. When used in lamp manufacture the cermets of the present invention are particularly suitable for use as end closure members for ceramic arc tubes for high pressure discharge lamps. Ceramics suitable for such lamp manufacture include light transmitting polycrystalline aluminium oxide, synthetic sapphire, yttriumoxide or a spinel. One or more conductor rods of a refractory material, such as tungsten or molybdenum can be embedded in the cermet body and sintered therein. The particular cermet for use in a lamp can be chosen to have a coefficient of thermal expansion between that of the material of the arc tube and any metallic component embedded in the cermet and in particular it should be noted that niobium containing cermets are a particularly good expansion match with aluminium oxide since the rates of thermal expansion are very similar. In this way end closure members for discharge lamps arc tubes can be made with electrode mountings and leads sealed into the cermet end closure members. The incorporation of a small amount of magnesium oxide (i.e. at least 0.01% by weight of refractory oxide) during the manufacture of the refractory oxide granules is found to give beneficial results. However too much magnesia (i.e. more than 0.25% by weight of refractory oxide) must not be used since this would tend to lead to the formation of cavities in the ceramic islands which would impair the mechanical strength of the cermet.

Tests we have made show that stabilisation times of 15 to 30 minutes, and in some cases as low as 2 minutes, can be achieved. It is to be borne in mind that in this case the niobium metal will form the three dimensional metallic network which will impart the electrical conductivity to the cermet member. It is highly surprising, therefore, that the hydrogen gas can be transported through this three dimensional maze in as little as 15 minutes and in some cases as little as 2 minutes as mentioned above.

The invention will now be described by way of example only and with reference to the accompanying drawings wherein.

Figure 1:
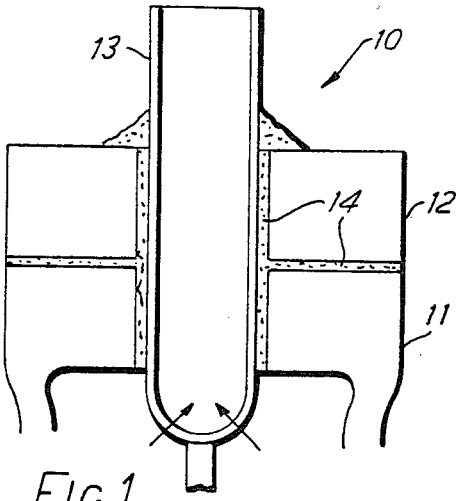
FIG. 1 shows a niobium tubular current lead-in member sealed through an alumina end closure arrangement of an alumina discharge arc tube (prior art).

In FIG. 1 reference numeral 10 indicates a conventional discharge arc tube end closure assembly for a high pressure sodium discharge lamp. This comprises an alumina discharge arc tube 11 and end closure cap 12. A niobium tube 13 forms a current lead-in member and is sealed through the end of the alumina arc tube and end cap 12 with a suitable sealing material 14. Because of the thin wall section of the tube any hydrogen present in the arc discharge tube very quickly diffuses through the tubular wall as indicated by the arrows in FIG. 1 and can be absorbed by a suitable getter material supplied for this purpose. In a typical 400 watt high pressure sodium discharge lamp according to this design the transportation diffusion time will be of the order of 2 to 3 minutes.

Figure 2:
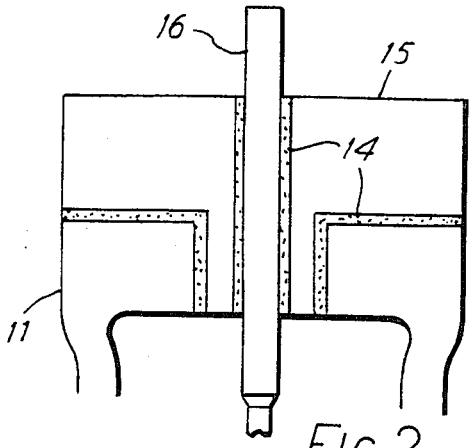
FIG. 2 shows a current lead-in member of niobium rod sealed in the alumina end closure arrangement of an alumina arc discharge tube (prior art).

In FIG. 2 a "top-hat" shaped member 15 of alumina is sealed to the alumina tube 11 and current lead-in member 16, within the top-hat member by sealing material 14. The current lead-in member 16 in this case is formed from niobium rod. This arrangement also is known.

Figure 3:
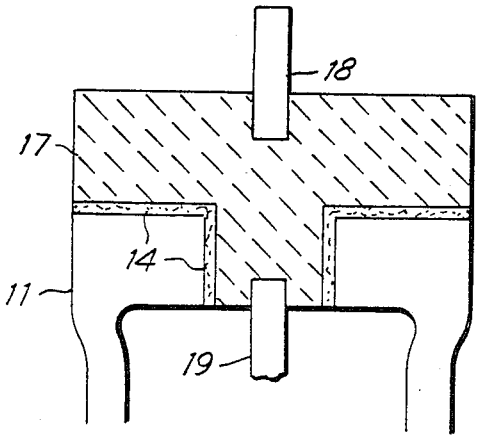
FIG. 3 shows a cermet end closure member in an alumina discharge arc tube for a high pressure sodium discharge lamp arranged to transport hydrogen according to this invention.
Figure 4:
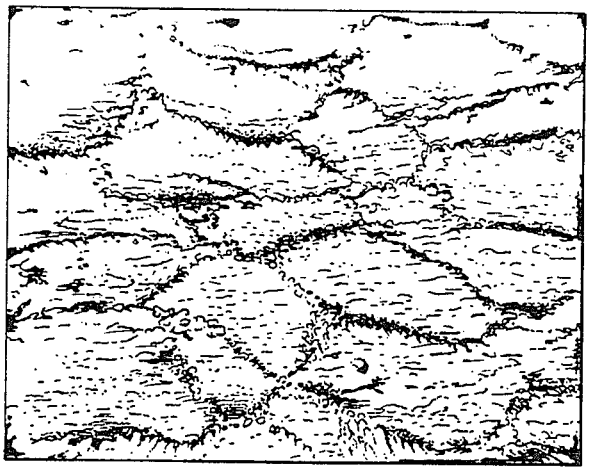
FIG. 4 is a photomicrograph (×400) of a conducting cermet permeable to hydrogen according to the present invention.

An arrangement according to the present invention is shown in FIG. 3. In this case a "top hat" shaped alumina/niobium electrically conducting cermet member 17 is sealed to the alumina discharge arc tube 11 by a sealing material 14. The cermet member 17, carries an external electrical conducting member 18 for connection to a supply and an internal conducting member 19 for connection to the discharge electrode (not shown). The niobium cermet 17 is not only electrically conducting but is arranged to transport passage of hydrogen along the conductive network formed by the niobium metal. FIG. 4 is a photomicrograph of a niobium cermet according to this embodiment of the invention and the patchwork pattern of niobium metal forming the conductive and hydrogen transportation network is clearly visible. Despite the obvious increase in path length our tests have shown that the transportation time through the cermet 17 is not much greater than that through the niobium rod. Electrically conducting cermet members for use as end closure members in high pressure discharge lamps and arranged to transport hydrogen according to this invention can be made up as follows:

EXAMPLE 1

(a) Preparation of the Oxide Granules

Alumina powder of 99.98% purity, largely in the alpha crystalline form, of mean particle size 0.3 microns and of surface area 30 $m^2$/gram (type CR30 supplied by La Pierre Synthetique Baikowski)—750 grams thereof—together with tungsten powder (Lamp Metals) of 99.98% purity and of mean particle size 5 microns—75 grams thereof—and high purity finely divided (submicron size) magnesium oxide—0.375 grams thereof—were mixed in a tumbler mixer for an hour. The mixed powder was then stirred with 2 liters of distilled water and then the slurry wet milled for 6 hours. The milled slurry was then dried in trays in an oven at 1OO° C. The dried slurry was then pushed through a 710 micron mesh and then finally sized by passing through a 500 microns sieve to produce granules of size range 50 to 500 microns and of average diameter 250 microns. The resultant granules contain tungsten in a volume fraction of 0.02 of the total volume of the granules in the form of particles of a mean particle size of 5 microns dispersed therein.

(b) Preparation of the Cermet

The granules of alumina containing dispersed tungsten particles were rolled in niobium powder of mean particle size 3 microns until they were uniformly coated with a volume fraction of about 0.12 of the powder (equivalent 30 parts by weight of niobium).

The coated granules were then compressed to form a coherent body or "green compact", preferably by isostatic compaction using a compacting pressure of up to 20,000 psi (138 $MN/m^2$) preferably about 11,500 psi (79 $MN/m^2$). The green compact can be formed in the desired component shape, but the compacted material should advantageously have sufficient mechanical strength before sintering to enable the shaped compact to be worked to the desired form. The green compact was then sintered for one hour in a furnace wherein the temperature was controlled in the range 1850° C. to 1890° C., but preferably at about 1875° C. at a vacuum of about $1\times10^{-5}$ Torr.

EXAMPLE 2

The method of example 1(a) is repeated. The resulting granules are made into cermets as follows. The alumina granules containing dispersed tungsten are rolled in a mixture of niobium and molybdenum (15 parts by weight of niobium to 10 parts by weight of molybdenum) until they are coated with a uniform coating of powder corresponding to a volume fraction of niobium of 0.062 and a volume fraction of niobium plus molybdenum of 0.098. The niobium and molybdenum being previously mixed by working in an inert container such as a glass jar for 30 minutes to ensure the mixture, as far as possible is homogenous.

The coated granules are then compressed to form a coherent body or "green compact", preferably by isostatic compaction using a compacting pressure of up to 20,000 psi (138 $MN/m^2$) preferably about 11,500 psi (79 $MN/m^2$). The green compact can be formed in the desired component shape, but the compacted material should advantageously have sufficient mechanical strength before sintering to enable the shaped compact to be worked to the desired form. The green compact was then sintered for one hour in a furnace wherein the temperature was controlled in the range 1850° C. to 1890° C. at a vacuum of about $1\times10^{-5}$ Torr.

EXAMPLE 3

(a) Preparation of Refractory Oxide Granules 750 grams of Alumina powder of 99.98% purity, largely in the alpha crystalline form, of mean particle size 0.3 microns and of surface area of 30 $m^2$/gram (type CR30 supplied by La Pierre Synthetique Baikowski) and 0.375 grams of high purity finely divided (submicron size) magnesium oxide were mixed in a tumbler mixer for one hour. The mixed powder was then stirred with distilled water (2 liters) and the slurry wet milled for 6 hours. The slurry was then put into trays and oven dried at 1OO° C. The dried slurry was then pushed through a 710 micron mesh and finally sized by passing through a 500 microns sieve to produce granules of size range 50 to 500 microns and of average diameter about 250 microns.

(b) Preparation of the Cermet

The granules of alumina were rolled in niobium powder of mean particle size 3 microns until they were uniformly coated with a volume fraction of 0.12 (equivalent to 30 parts by weight of niobium).

The coated granules were then compressed to form a coherent body or "green compact", preferably by isostatic compaction using a compacting pressure of up to 20,000 psi (138 $MN/m^2$) preferably about 11,500 psi (79 $MN/m^2$).

The green compact can be formed in the desired component shape, but the compacted material should advantageously have sufficient mechanical strength before sintering to enable the shaped compact to be worked to the desired form.

The green compact was then sintered for one hour in a furnace wherein the temperature was controlled in the range 1850° C. to 1890° C. but preferably at about 1875° C. at a vacuum of about $1\times10^{-5}$ Torr.

It should be noted that while a preferred range of temperature for sintering the green compact is 1850° C. to 1890° C. a suitable sintering temperature range is 1700° C. to 1900° C.

Some cermets made in accordance with either example 1 or example 2 were made up and assembled into end closure assemblies of 400 watt high pressure sodium discharge lamps. When tested the lamps were found to have stabilisation times in all cases of less than 30 minutes, with an average value of around 15 minutes.

With the present invention it is believed a minimum volume fraction of 0.06 of the total cermet of niobium is necessary to ensure adequate hydrogen transportation whilst to achieve the desired expansion characteristics a maximum value for the volume fraction of metal in the total cermet is 0.2. In addition to niobium; tantalum, molybdenum and tungsten are the preferred metals with which to make up the cermets, particularly molybdenum and tungsten since these material are commonly used in lamp manufacture. Since the cermets of this invention are particularly suited to use in end closure assemblies for ceramic discharge lamp arc tubes and since a common material for such arc tubes is alumina, the preferred refractory oxide is alumina. Any form of alumina may be used but it is convenient to use a starting material which is already in the crystalline form, for example, in the alpha (hexagonal) or gamma (cubic) crystalline form. A powdered alumina of submicron particle size is found to be a particularly convenient starting material. Where a metal is dispersed within the refractory oxide it is desirable that at least a volume fraction of 0.01 of the total cermet be included but the total amount of metal dispersed should be limited to a volume fraction of 0.15 of the total cermet since above this there is a tendency for the dispersed metal to promote cracking of the sintered cermet.

It will be appreciated that the actual stabilisation time will be dependent on, inter alia, the actual amount of contaminants in the discharge arc tube. It is desirable to have this time as low as possible or, as near as possible, to what could be considered the standard stabilisation time of 2 to 3 minutes for a niobium tubular current lead-in member. Our tests have shown that it is possible to achieve stabilisation times of between 15 and 30 minutes and as low as 2 minutes using an alumina discharge arc tube closed at both ends with niobium cermets as disclosed herein.

What we claim is:

1. An electrically conducting cermet comprising a sintered compact of refractory oxide granules having diameters of from 50 to 800 microns, and a conductive network extending throughout the cermet wherein said network is provided by a layer of metal, said layer comprising niobium and, optionally, at least one other metal selected from titanium, zirconium, hafnium, vanadium, tantalum, molybdenum and tungsten, said layer constituting a volume fraction of 0.06 to 0.2 of the cermet and the minimum niobium content of said layer constituting a volume fraction of 0.06 of the total cermet, and wherein said granules comprise 0.01 to 0.25 percent by weight of the refractory oxide of finely divided magnesium oxide and either:

(a) a refractory oxide selected from the group consisting of aluminium oxide, yttrium oxide or a spinel, or (b) a refractory oxide such as aluminium oxide, yttrium oxide or a spinel and at least one metal selected from titanium, zirconium, hafnium, vanadium, tantalum, chromium, molybdenum, tungsten, iron, cobalt and nickel in a volume fraction of from 0.01 to 0.15 of the total volume of the granules.

2. A cermet according to claim 1 wherein said metal layer comprises niobium and at least one other metal selected from tantalum, molybdenum and tungsten.

3. A cermet according to claim 2 wherein said metal layer comprises niobium and molybdenum.

4. A cermet according to claim 1 wherein said metal layer comprises niobium only.

5. A cermet according to claim 1 wherein said refractory oxide granules comprise magnesium oxide and either aluminium oxide alone or aluminium oxide and tungsten.

* * * * *